US005573342A

United States Patent [19]

Patalano

[11] Patent Number: 5,573,342

[45] Date of Patent: Nov. 12, 1996

[54] BODY LOTION APPLICATOR SYSTEM

[76] Inventor: Christine S. Patalano, 264 Fruit Hill Ave., #2, North Providence, R.I. 02911

[21] Appl. No.: 493,220

[22] Filed: Jun. 20, 1995

[51] Int. Cl.[6] ..... A45D 34/00; A45D 40/06

[52] U.S. Cl. ..... 401/175; 401/6; 401/140; 401/207

[58] Field of Search ..... 401/6, 175, 207, 401/140

[56] References Cited

U.S. PATENT DOCUMENTS

| | | | |
|---|---|---|---|
| 1,218,393 | 3/1917 | Gensmer | 401/175 |
| 1,620,801 | 3/1927 | Clark | 401/207 |
| 3,807,881 | 4/1974 | Seidler | 401/175 |
| 4,171,171 | 10/1979 | Jones | 401/6 X |

FOREIGN PATENT DOCUMENTS

| | | | |
|---|---|---|---|
| 2625743 | 12/1977 | Germany | 401/175 |
| 57475 | 3/1922 | Switzerland | 401/175 |
| 145665 | 5/1931 | Switzerland | 401/175 |
| 300537 | 10/1954 | Switzerland | 401/175 |

*Primary Examiner*—Steven A. Bratlie

[57] ABSTRACT

A body lotion applicator system to enable a user to conveniently apply hand cream and other skin preparations to the back and other hard-to-reach areas of the body is disclosed. Such system comprises a reservoir in a tubular configuration with an exterior surface and an interior surface and having a circular cross-section. The reservoir has a closed upper end with a filling aperture therein and a closed lower end with a first bearing aperture therethrough. The reservoir also has an intermediate extent therebetween. A bearing plate is located interior thereof adjacent the upper end with passages therethrough and with a second bearing aperture therethrough. An application box is secured to the exterior surface of the reservoir adjacent to the upper end. The application box includes a common wall with the reservoir and is formed with a plurality of feed holes extending therethrough for the passage of lotion to the application box from the reservoir. The application box also has peripheral side walls and an exterior wall with a dispensing hole therethrough for the passage of lotion to the body of a user from the application box during operation and use.

1 Claim, 3 Drawing Sheets

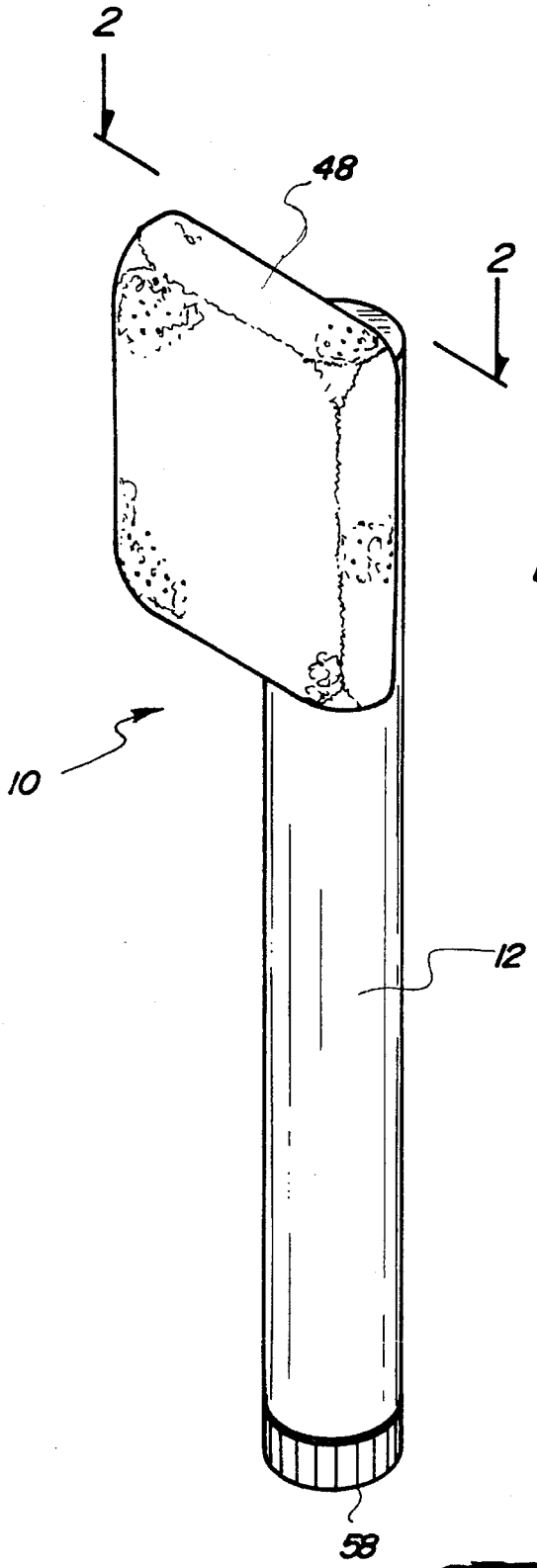
Fig. 1
Fig. 2
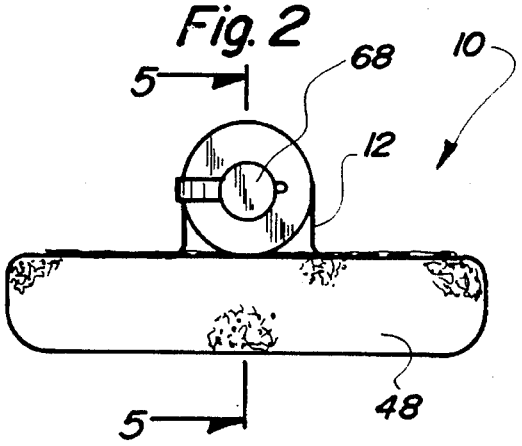

34
4
68
18
48
4
40
12

44
40
42

BODY LOTION APPLICATOR SYSTEM

BACKGROUND OF THE INVENTION

1. Field of the Invention

The present invention relates to a new and improved body lotion applicator system and, more particularly, pertains to applying body lotion to one's own body at hard-to-reach locations through an applicator with adjustable lotion dispensing components.

2. Description of the Prior Art

The use of devices for applying lotions, soaps or other fluids through apparatuses of various designs and configurations is known in the prior art. More specifically, devices for applying lotions, soaps or other fluids through apparatuses of various designs and configurations heretofore devised and utilized for the purpose of applying lotions or other fluids through any various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for applying body lotion to one's own body at hard-to-reach locations through an applicator with adjustable lotion dispensing components. By way of example, U.S. Pat. No. 3,870,419 to Sage discloses a back scrubber, massager and lotion applicator.

U.S. Pat. No. 5,240,339 to DeForest et al. discloses a body lotion applicator with applicator head pivotally mounted on tubular extension arm.

U.S. Pat. No. 5,341,538 to Bansome discloses a sun lotion applicator.

U.S. Pat. No Des. 289,564 to Harford discloses a suntan lotion applicator.

Lastly, U.S. Pat. No. Des. 313,553 to Lewis, Jr. discloses a combined lotion applicator and reservoir handle.

In this respect, the body lotion applicator system according to the present invention substantially departs from the conventional concepts and designs of the prior art, and in doing so provides an apparatus primarily developed for the purpose of applying body lotion to one's own body at hard-to-reach locations through an applicator with adjustable lotion dispensing components.

Therefore, it can be appreciated that there exists a continuing need for a new and improved body lotion applicator system which can be used for applying body lotion to one's own body at hard-to-reach locations through an applicator with adjustable lotion dispensing components. In this regard, the present invention substantially fulfills this need.

SUMMARY OF THE INVENTION

In view of the foregoing disadvantages inherent in the known types of devices for applying lotions, soaps or other fluids through apparatuses of various designs now present in the prior art, the present invention provides an improved body lotion applicator system. As such, the general purpose of the present invention, which will be described subsequently in greater detail, is to provide a new and improved body lotion applicator system and methods which have all the advantages of the prior art and none of the disadvantages.

To attain this, the present invention essentially comprises a new and improved body lotion applicator system to enable a user to conveniently apply hand cream and other skin preparations to the back and other hard-to-reach areas of the body comprising, in combination, a reservoir in a tubular configuration with an exterior surface and an interior surface and having a circular cross-section, the reservoir having a closed upper end with a filling aperture therein and having a closed lower end with a first bearing aperture therethrough and with an intermediate extent therebetween, the reservoir also having a bearing plate interior thereof adjacent the upper end with passages therethrough and with a second bearing aperture therethrough; an application box secured to the exterior surface of the reservoir adjacent to the upper end, the application box including a common wall with the reservoir and formed with a plurality of feed holes extending therethrough for the passage of lotion to the application box from the reservoir, the application box also having rectangular peripheral side walls and an exterior wall remote from the common wall with a dispensing hole therethrough for the passage of lotion to the body of a user from the application box during operation and use; a removable pad positionable over the side walls and front wall of the application box for the dissemination of lotion therethrough; a jack screw having an upper end rotatably received in the second bearing aperture and having a lower end rotatably received in the first bearing aperture and extending through the lower end of the reservoir with a rotatable handle secured to the jack screw beneath the lower end; a circular washer axially slidable within the reservoir and having a threaded interior received on the jack screw and having an elastomeric O-ring in sealing contact on the washer and movable along the interior surface of the reservoir; and a fill cap removably secured with respect to the filling aperture in the upper end of the reservoir for allowing the addition of lotion to the upper extent of the reservoir above the washer for being dispensed through the fill holes of the common wall and then the dispensing hole of the application box and pad during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved body lotion applicator system which has all the advantages of the prior art devices for applying lotions, soaps or other fluids through apparatuses of various designs and none of the disadvantages.

It is another object of the present invention to provide a new and improved body lotion applicator system which may be easily and efficiently manufactured and marketed.

It is a further object of the present invention to provide a new and improved body lotion applicator system which is of a durable and reliable construction.

An even further object of the present invention is to provide a new and improved body lotion applicator system which is susceptible of a low cost of manufacture with regard to both materials and labor, and which accordingly is then susceptible of low prices of sale to the consuming public, thereby making such devices for applying lotions, soaps or other fluids through apparatuses of various designs economically available to the buying public.

Still yet another object of the present invention is to provide a new and improved body lotion applicator system which provides in the apparatuses and methods of the prior art some of the advantages thereof, while simultaneously overcoming some of the disadvantages normally associated therewith.

Even still another object of the present invention is to apply body lotion to one's own body at hard-to-reach locations through an applicator with adjustable lotion dispensing components.

Lastly, it is an object of the present invention to provide a body lotion applicator system to enable a user to conveniently apply hand cream and other skin preparations to the back and other hard-to-reach areas of the body. Such system comprises a reservoir in a tubular configuration with an exterior surface and an interior surface and having a circular cross-section. The reservoir has a closed upper end with a filling aperture therein and a closed lower end with a first bearing aperture therethrough. The reservoir also has an intermediate extent therebetween. A bearing plate is located interior thereof adjacent the upper end with passages therethrough and with a second bearing aperture therethrough. An application box is secured to the exterior surface of the reservoir adjacent to the upper end. The application box includes a common wall with the reservoir and is formed with a plurality of feed holes extending therethrough for the passage of lotion to the application box from the reservoir. The application box also has peripheral side walls and an exterior wall with a dispensing hole therethrough for the passage of lotion to the body of a user from the application box during operation and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the new and improved body lotion applicator system constructed in accordance with the principles of the present invention.

FIG. 2 is a top elevational view thereof.

The same reference numerals refer to the same parts throughout the various FIGS.

DESCRIPTION OF THE PREFERRED EMBODIMENT

Figure 3:
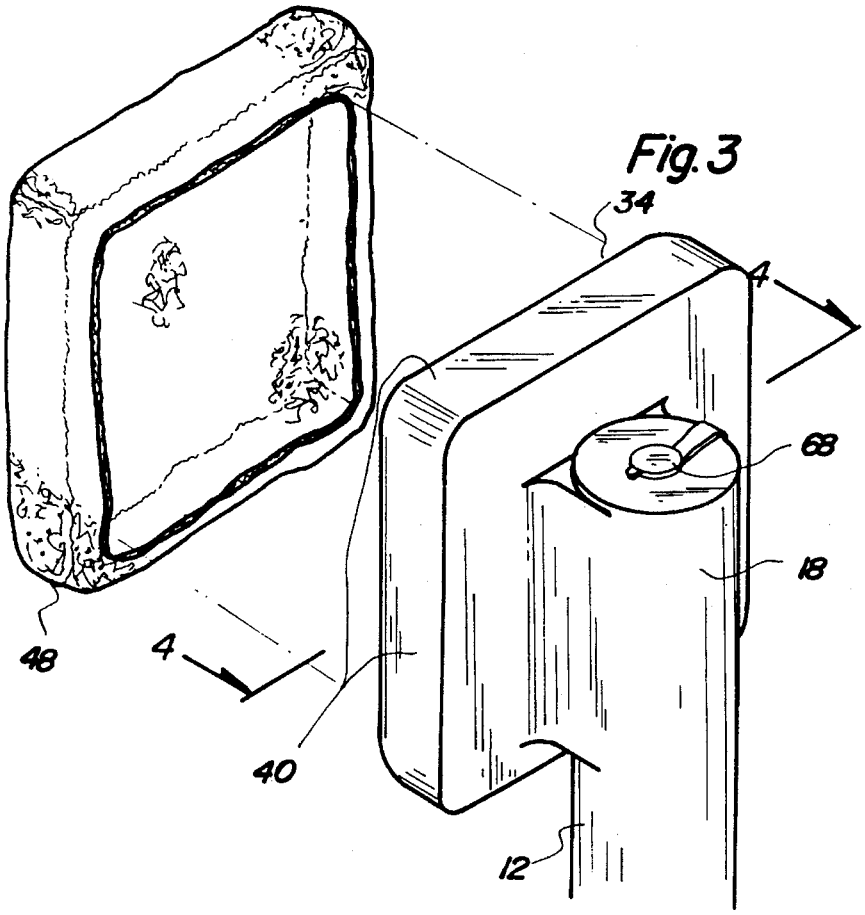
FIG. 3 is an exploded perspective view of the upper portion of the applicator shown in FIGS. 1 and 2.
Figure 4:
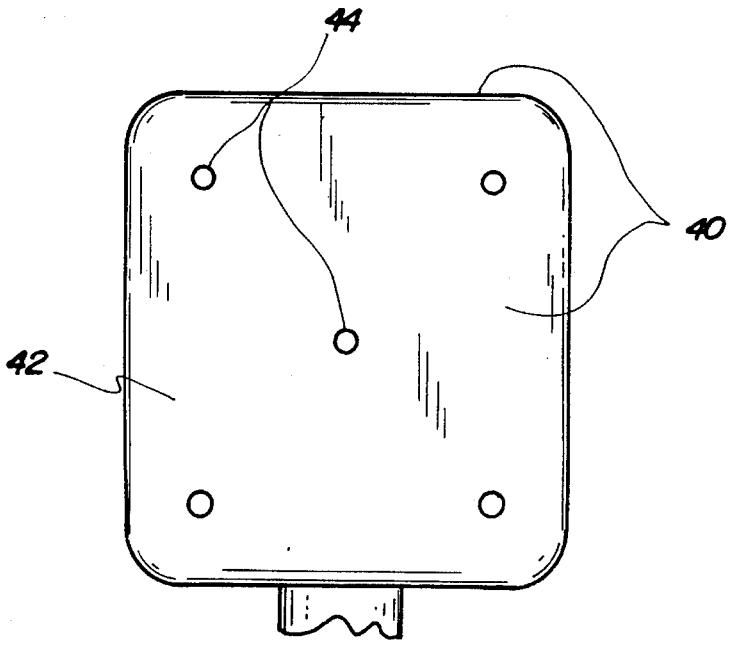
FIG. 4 is an elevational view of the applicator box shown in the prior FIGS. taken along line 4—4 of FIG. 3.
Figure 5:
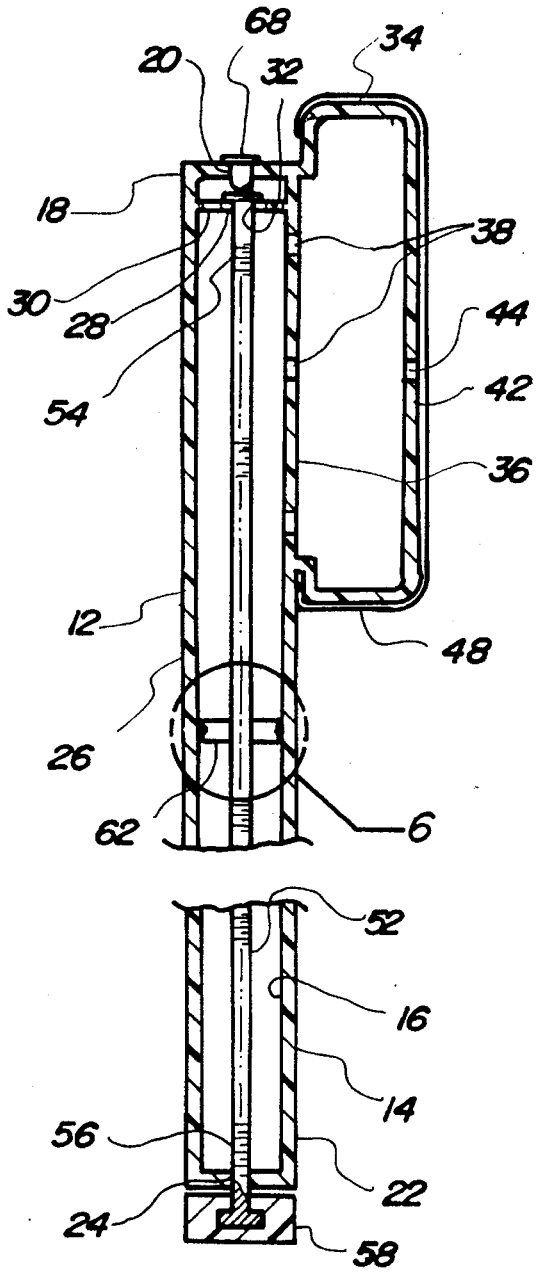
FIG. 5 is a cross-sectional view of the device shown in the prior Figures taken centrally through the axis of the reservoir or handle.
Figure 6:
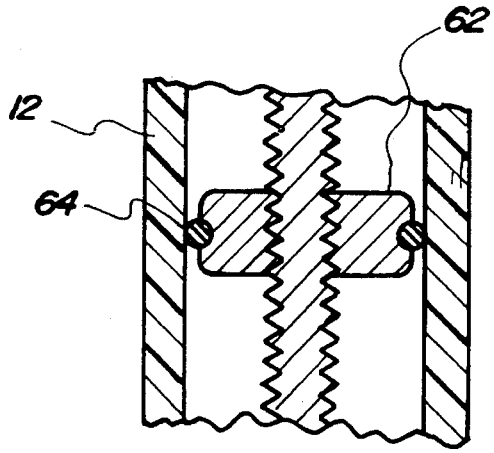
FIG. 6 is an enlarged cross-sectional view of a portion of the device shown in FIG. 5 at circle 6 of FIG. 5.

With reference now to the drawings, and in particular to FIG. 1 thereof, the preferred embodiment of the new and improved body lotion applicator system embodying the principles and concepts of the present invention and generally designated by the reference numeral 10 will be described.

The present invention, the new and improved body lotion applicator system is a system 10 comprised of a plurality of components. In their broadest context, the components include the reservoir or handle, an application box, a removable pad, a jack screw, a washer and a fill cap. Each of the individual components is specifically configured and correlated one with respect to the other so as to attain the desired objectives.

More specifically, the present invention is a system 10. Its major component is a reservoir 12 or handle. Such component is in a tubular configuration. It has an exterior surface 14 and an interior surface 16. Such are both formed with a circular cross-sectional configuration.

The reservoir is formed to have a closed upper end 18. Such upper end has a filling aperture 20 centrally located therein. The reservoir also has a closed lower end 22. Such closed end has a first bearing aperture 24 therethrough. An intermediate extent 26 is located between the upper and lower ends. The reservoir also has a bearing plate 28 in the interior thereof adjacent to the upper end. Such bearing plate has a bearing aperture 32 therethrough. In addition, passages 30 extend through the bearing plate for the passage of lotions to be dispensed from exterior of the device to an enlarged area beneath the bearing plate and interior of the reservoir.

The next major component of the system is an application box 34. Such box is secured to the exterior surface of the reservoir. It is located adjacent to the upper end thereof. The application box includes a common wall 36 which is common with the reservoir. The common wall is formed with a plurality of feed holes 38 extending therethrough. Such feed holes are for the passage of lotion to the application box from the reservoir. The application box also has rectangular, peripheral side walls 40. It also has an exterior wall 42 remote from the common wall. Dispensing holes 44 extend through the exterior wall. Such dispensing holes are for the passage of lotion to the body of the user from the application box during operation and use.

Next provided is a removable pad 48. Such removable pad is configured to be positioned over the exterior wall and side walls of the application box. The removable pad is for dissemination of lotion therethrough when fed from the application box to the user. Located within the reservoir is a jack screw 52. The jack screw has an axis of rotation coincident with the central axis of the reservoir. The jack screw has an upper end 54 rotatably received in the second bearing aperture. The jack screw also has a lower end 56 rotatably received in the first bearing aperture. The lower end of the jack screw extends through the lower plate of the reservoir. At such location exterior the reservoir, the jack screw is provided with a rotatable handle 58. Such handle is secured to the jack screw beneath the lower end of the reservoir for being contacted and rotated by a user.

Slidably located within the reservoir is a circular washer 62. The sliding of the washer is axially within the reservoir with a central axis coincident with the axis of the jack screw and the reservoir. The circular washer has a threaded interior aperture received on the threads of the jack screw. In this manner, rotation of the jack screw will effect the axial movement of the cylindrical washer. An elastomeric O-ring 64 is secured to the exterior periphery of the washer. The O-ring is in sealing contact between the washer and the interior surface of the reservoir along which it is movable with respect to the interior surface of the reservoir. This allows for an upper extent of the reservoir of the washer for receiving a predetermined quantity of lotion to be dispensed. Beneath the circular washer is a space also variable in size as a function of the location of the washer and the quantity of lotion thereabove for being dispensed.

The last component of the system is a fill cap 68. Such fill cap is removably secured with respect to and within the filling aperture in the upper end of the reservoir. A flexible strap couples the cap to the adjacent exterior surface of the reservoir to preclude the losing thereof when the fill cap is removed. The fill cap is for allowing removal thereof for the addition of lotion to the upper extent of the reservoir above the washer. In this manner, lotion may be added to the reservoir for being dispensed through the fill holes of the common wall and then the dispensing holes of the application box and finally through the pad to the user during operation and use.

The present invention comprises a body lotion applicator system which enables the user to conveniently apply hand cream or other skin preparations to the back and hard—to—reach areas of the body.

Approximately 14.5 inches in length, the present invention consists of a hollow tube in which the lotion is stored. One end of this cylinder features a twist knob which maneuvers an inner plastic screw and stopper to slide within the unit, forcing the cream through a small hole directly beneath the head. The head measures approximately 3.25 inches in length and 2.5 inches in width and features three dispensing holes covered by a removable, elasticized sponge. Also located at this end is a small rubber-capped hole through which the hand cream is inserted into the device.

Lotion is inserted into the tube through the rubber flip-top cap. To dispense it, the user simply twists the base knob which forces the inner stopper towards the applicator head. As the stopper moves upward, the preparation is pushed through the small hole in the tube and into the sponge. It is then gently rubbed onto the back, twisting the knob for additional cream as needed. After use, the sponge is removed and cleaned.

The present invention is convenient and practical. It enables the user to easily apply lotion to the back and other areas of the body without assistance. It is ideal for body or suntan preparations as well as medicinal creams.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved body lotion applicator system to enable a user to conveniently apply hand cream and other skin preparations to the back and other hard-to-reach areas of the body comprising, in combination:

a reservoir in a tubular configuration with an exterior surface and an interior surface and having a circular cross-section, the reservoir having a closed upper end with a filling aperture therein and having a closed lower end with a first bearing aperture therethrough and with an intermediate extent therebetween, the reservoir also having a bearing plate interior thereof adjacent the upper end and with passages therethrough and with a second bearing aperture therethrough;

an application box secured to the exterior surface of the reservoir adjacent to the upper end, the application box including a common wall with the reservoir and formed with a plurality of feed holes extending therethrough for the passage of lotion to the application box from the reservoir, the application box also having rectangular peripheral side walls and an exterior wall remote from the common wall with a dispensing hole therethrough for the passage of lotion to the body of a user from the application box during operation and use;

a removable pad positionable over the side walls and front wall of the application box for the dissemination of lotion therethrough;

a jack screw having an upper end rotatably received in the second bearing aperture and having a lower end rotatably received in the first bearing aperture and extending through the lower end of the reservoir with a rotatable handle secured to the jack screw beneath the lower end;

a circular washer axially slidable within the reservoir and having a threaded interior received on the jack screw and having an elastomeric O-ring in sealing contact around the periphery of the washer and movable along the interior surface of the reservoir; and a fill cap removably secured by a flexible strap with respect to the filling aperture in the upper end of the reservoir for allowing the addition of lotion to the upper extent of the reservoir above the washer for being dispensed through the fill holes of the common wall and then the dispensing hole of the application box and pad during operation and use.

* * * * *